US005194021A

United States Patent [19]

Oba et al.

[11] Patent Number: 5,194,021

[45] Date of Patent: Mar. 16, 1993

[54] CONNECTOR

[75] Inventors: Toshihiro Oba; Mutsuo Kikuchi; Isamu Taka, all of Tokai, Japan

[73] Assignee: Japan Atomic Energy Research Institute, Tokyo, Japan

[21] Appl. No.: 772,880

[22] Filed: Oct. 8, 1991

[30] Foreign Application Priority Data

Oct. 12, 1990 [JP] Japan ..... 2-272182

[51] Int. Cl.[5] ..... H01R 13/40

[52] U.S. Cl. ..... 439/589; 439/604; 439/936

[58] Field of Search ..... 439/199, 201, 204, 519, 439/521, 589, 936, 604, 606

[56] References Cited

U.S. PATENT DOCUMENTS

| | | | |
|---|---|---|---|
| 3,487,353 | 12/1969 | Massa | 439/936 X |
| 3,744,128 | 7/1973 | Fisher et al. | 439/936 X |
| 3,963,297 | 6/1976 | Panek et al. | 439/204 |
| 4,335,932 | 6/1982 | Herrmann, Jr. | 439/936 X |
| 4,662,692 | 5/1987 | Uken et al. | 439/936 X |
| 4,679,875 | 7/1987 | Ramsey | 439/604 |
| 4,927,386 | 5/1990 | Neuroth | 439/589 |
| 5,104,340 | 4/1992 | Elam et al. | 439/936 X |

*Primary Examiner*—Larry I. Schwartz
*Assistant Examiner*—Khiem Nguyen
*Attorney, Agent, or Firm*—Oblon, Spivak, McClelland, Maier & Neustadt

[57] ABSTRACT

A connector which is particularly suitable for providing an interface between first and second environments, particularly where one of the environments is at an elevated temperature and/or pressure with respect to the other environment. The connector provides a reliable exit for a plurality of electrical wires, and includes a three layer laminate structure, with each of the layers formed of a resinous adhesive.

2 Claims, 1 Drawing Sheet

CONNECTOR

BACKGROUND OF THE INVENTION (a) Field of the Invention

The present invention relates to a connector.

More particularly, the present invention relates to a connector for pressure or vacuum equipments.

(b) Description of the Prior Art

A connector for general instrumentation is sufficient for common use so long as it has insulation quality and is low in electrical resistance in the joint and also is of such a structure to be capable of repeatedly fitting together and taken apart.

Thus, a connector which is taken pressure and vacuum performance into consideration is scarcely on the market.

A connector for instrumentation used in atomic energy applications is required to be of a structure which prevents the leakage of fission product gas and simultaneously is desired to be compact in shape and to be of such a structure that numerous instrumentation wires can be taken out.

A connector which has previously been developed in the Japan Atomic Energy Research Institute is of a structure that the whole portions of taking out or exiting instrumentation wires are solidified with a resinous adhesive for the purpose of preventing the leakage of helium gas.

However, in such connector, solidified adhesive portions in a connector holder within housing and a sealing of taking-out mouth of instrumentation wire are peeled out by expansion and shrinking due to temperature change and other causes, and so, such a phenomenon that the pressure and vacuum performance deteriorates occurs frequently.

SUMMARY OF THE INVENTION

An object of the present invention is to provide an improved connector which solves the above described problems.

As the result of applying themselves to research for attaining this object, the present inventors have come to invent the present connector which is characterized in that, in a connector in which the whole portions of taking out instrumentation wires are solidified with a resinous adhesive, said adhessive filling-up portion is composed of a fixing layer, a sealing layer and a pressure layer in a laminated manner.

1 connector pin (+);

2 connector;

3 connector pin-fixing layer;

4 housing;

5 sealing layer;

6 joint;

7 lead wire fixing layer (pressure layer);

8 lead wire;

9 partition board;

10 connector pin (−).

DESCRIPTION OF THE PREFERRED EMBODIMENT

Figure 1A:
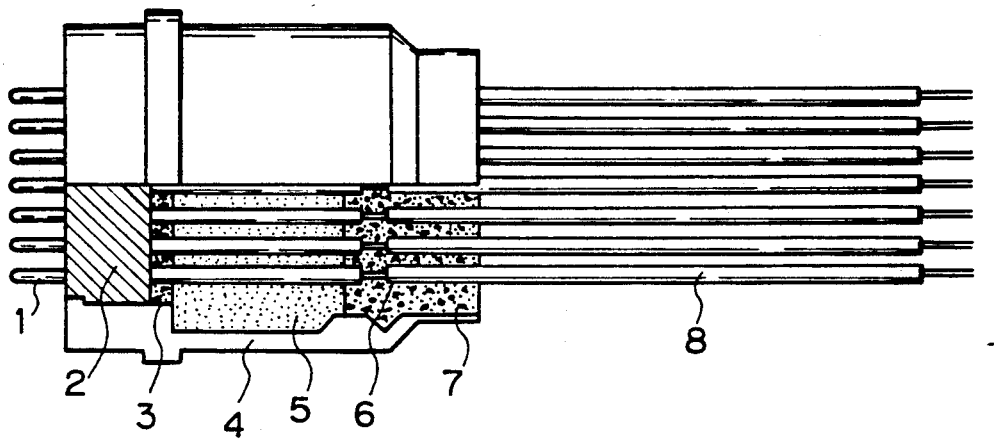
FIG. 1A illustrates a connector in accordance with one embodiment of the present invention in partial cross-section.

The connector of the present invention will be explained with reference to FIGS. 1A and 1B.

In the figure, the adhessive filling-up portion, in which the whole portions of taking out instrumentation wires are solidified with a resinous adhesive, is divided into a connector pin-fixing layer 3, a sealing layer 5 and a lead wire fixing layer (pressure layer) 7 to constitute a laminate within the connector housing 4.

By such a laminated constitution of the adhessive filling-up portion, the pressure and vacuum performance of connector is improved.

Figure 1B:
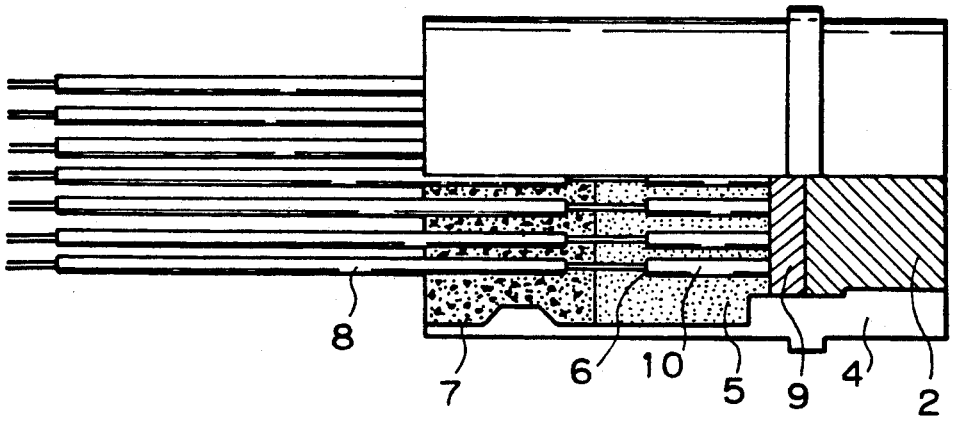
FIG. 1B illustrates a second embodiment of the present invention in a partial cross-section.

In case of using the present connector in a higher pressure atmosphere, in the inside and outside load, it is possible to take measures to meet the situation by using a partition board 9, or strengthening the structure of housing 4 as shown in FIG. 1B.

By using the connector of the present invention, the airtight performance of instrumentation connector used in a nuclear reactor and the like can be attained (the amount of helium leaked: $1\times10^{-10}$Atm . cc/sec) with satisfactory pressure performance simultaneously. obtained.

And the sealing layer 5 is soft rubber-like and is possible to sufficiently cope with the change of external stress so that a peeling phenomenon does not break out and a long use becomes possible.

What is claimed is:

1. A connector for providing an exit interface for a plurality of wires in which the wires pass from a first environment through said connector to a second environment, the connector comprising:

a housing through which a plurality of wires pass;

at least a portion of said housing being entirely filled with resinous adhesive sections except for portions allowing the plurality of wires to pass therethrough; and wherein said resinous adhesive sections comprise a laminate structure which includes a connector pin-fixing layer, a sealing layer immediately adjacent to said connector pin-fixing layer, and a lead wire fixing layer immediately adjacent to said sealing layer, wherein said connector pin-fixing layer, sealing layer and lead wire fixing layer together form a resinous adhesive laminate within said housing.

2. The connector of claim 1, wherein said sealing layer is a soft rubber-like resinous adhesive.

* * * * *